US005485137A

United States Patent [19]

Maléus et al.

[11] Patent Number: 5,485,137

[45] Date of Patent: Jan. 16, 1996

[54] METHOD FOR MANUFACTURING A FUSE AND A FUSE MADE BY THAT METHOD

[75] Inventors: Börje Maléus, Järfälla; Jan Tjerngren, Ludvika, both of Sweden

[73] Assignee: Asea Brown Boveri AB, Vasteras, Sweden

[21] Appl. No.: 232,161

[22] PCT Filed: Oct. 28, 1992

[86] PCT No.: PCT/SE92/00740

§ 371 Date: Apr. 29, 1994

§ 102(e) Date: Apr. 29, 1994

[87] PCT Pub. No.: WO93/10551

PCT Pub. Date: May 27, 1993

[30] Foreign Application Priority Data

Nov. 18, 1991 [SE] Sweden ..... 9103394

[51] Int. Cl.[6] ..... H01H 85/04

[52] U.S. Cl. ..... 337/295; 29/623; 29/874; 140/71 R

[58] Field of Search ..... 29/623, 874; 140/71 R; 337/290, 295

[56] References Cited

U.S. PATENT DOCUMENTS

| | | | |
|---|---|---|---|
| 550,638 | 12/1895 | McCulloch | 337/290 |
| 1,867,924 | 3/1929 | Roberts et al. | 337/290 |
| 2,000,163 | 5/1935 | Clark | 140/71 R |
| 2,659,790 | 11/1953 | Jurgensen | 29/623 |

FOREIGN PATENT DOCUMENTS

| | | | |
|---|---|---|---|
| 1263182 | 3/1968 | Germany | 29/623 |
| 427524 | 11/1947 | Italy | 140/71 |

*Primary Examiner*—P. W. Echols

*Attorney, Agent, or Firm*—Watson, Cole, Grindle & Watson

[57] ABSTRACT

A method for manufacturing a fuse comprising a fuse element (10), in the form of a single wire, which is formed together with at least one terminal (11,11*a*,11*b*), in the form of a number of twisted wires. The fuse element and the conductor(s) are formed from the same wire, whereby part of the wire is moved back and forth a number of times to form at least one ring (21) or loop. The ring or loop is twisted into a conductor (11,11*a*,11*b*) in the form of a number of twisted strands, whereby one of the twisted strands is formed to be included, in part, in the terminal (11,11*a*,11 *b*) twisted together with an additional number of wires and to constitute, in part, a fuse element (10).

14 Claims, 3 Drawing Sheets

METHOD FOR MANUFACTURING A FUSE AND A FUSE MADE BY THAT METHOD

TECHNICAL FIELD

The present invention relates to a method for manufacturing a fuse comprising a fuse element in the form of a wire and at least one terminal, the terminal having a larger cross section area than the fuse element.

BACKGROUND ART

A fuse comprises a fuse element, for example in the form of a wire, which at elevated current is heated and melts, the fuse blows, and the component that the fuse protects is disconnected.

In certain applications, such as fuses for protection of capacitor elements in power capacitors, the fuse comprises, in addition to fuse elements, also terminals which have a larger cross section area than the fuse element.

The fuse element usually consists of a wire, preferably a metal wire of copper, aluminium, silver, alloys based on these metals, as well as nickel silver, or any other material with a resistivity and melting point suitable for the application.

For a fuse element provided with terminals, the contacting, that is, the transition between terminal and fuse element, which with conventional technique is usually performed by means of soldering, welding or a mechanical pressure joint, is a critical step. The influence of heat from the soldering/welding or mechanical damage upon the contacting by means of the pressure joint weakens the fuse, preferably at the transition between terminal and fuse element. This has an adverse effect on the fuse and the protective function by the introduction of weakenings or other inhomogeneities in the fuse.

In connection with fuses in capacitor elements or in other components where the fuse is mounted "narrowly" and in close proximity to electrically loaded materials, all forms of mechanical pressure points must be avoided. For that reason, the transition between terminal and fuse element in fuses which make contact with or are mounted in close contact with electrically loaded materials, for example fuses mounted inside or adjacent to a capacitor element, must be of essentially the same dimension as the terminal, that is, no lumps of solder, welding material, mechanical clamps or the like, which exceed the dimensions of the terminal and create pressure points, can be allowed.

The invention aims to propose a method whereby a fuse, which comprises a fuse element in the form of a thin wire and at least one terminal, the terminal having a larger cross section area than the fuse element, can be manufactured in an economic and rational way while at the same time avoiding the above-mentioned problems arising in connection with the contacting or the transition between terminal and fuse element.

SUMMARY OF THE INVENTION

The invention relates to a method for manufacturing a fuse which comprises a fuse element in the form of a thin wire and at least one terminal, the terminal having a larger cross section area than the fuse element. The fuse element and the terminal are formed in one piece from the same wire while moving the wire, section-by-section, back and forth a number of times to form at least one ring or loop. The ring obtained is then twisted into a terminal in the form of a number of twisted-together wires, whereby one of the wires, included in part in the terminal, is formed also to partly constitute a fuse element. The method according to the invention simplifies the manufacture of fuses in relation to the known technique since no joining together of different components is required and all material, wire, is taken from the same roll.

According to a preferred embodiment of the method of the invention, fuses comprising two terminals and an intermediate fuse element are manufactured from the same wire. According to this embodiment, the wire is moved, section-by-section, back and forth a number of times to form at least one ring or loop. The ring thus formed is twisted to form a larger cross section area than the wire. Alternately with these sections of twisted wires, sections in the form of a single wire are arranged, whereupon the body formed from this wire, comprising sections in the form of a single wire, arranged alternately in the longitudinal direction with sections in the form of a number of twisted-together wires, are cut into fuses. By performing the cutting in the twisted sections, fuses comprising two terminals and an intermediate fuse element are obtained.

Since soldering, welding or mechanical joints are not needed in the manufacture of fuses with a method according to the invention, the problems arising in connection with the critical transition between terminal and fuse element are avoided.

In the manufacture of fuse elements using a method according to the invention, the fuse element and the terminal are preferably manufactured starting from a thin metal wire with a diameter smaller than 0.5 mm. Especially advantageous are fuses where the fuse element and the terminal are made in one piece from a thin wire of copper, aluminium, silver, alloys based on these metals, as well as electroplated nickel silver or any other metal or alloy having a resistivity and melting point suitable for the application.

To provide an inproved fuse of the type specified herein, it is advantageous to construct fuses from a thin metal wire. With a conventionally designed fuse where the contacting between the fuse element and the terminal is performed by means of welding, soldering or mechanical pressure contact, metal wires with a diameter smaller than 0.3 mm cannot normally be used. In the manufacture of a fuse according to the method of the invention, metal wires with a diameter smaller than 0.3 mm are used to advantage.

A fuse manufactured according to the method of the invention is used to advantage in a power capacitor comprising a number of capacitor elements, each capacitor element being connected in series with an internal fuse which comprises a fuse element, and at least one terminal, wherein a thin wire which constitutes the fuse element according to the invention is adapted, in part, to be included in the terminal twisted together with an additional number of wires.

The invention is particularly valuable in the manufacture of fuses intended to be used in a power capacitor which comprises a number of sub-capacitors or capacitor elements which are protected by means of so-called internal fuses since in these power capacitors each capacitor element is connected in series with its own fuse. For the fuses to occupy a minimum space, they are mounted inside the capacitor, preferably inside or in close proximity to the individual capacitor elements. The fuses are thus mounted clamped between electrically active material, whereby any form of mechanical pressure point, such as solder lumps, welding material, or mechanical joints, is undesirable. A fuse manufactured by means of a method according to the invention is advantageously performed starting from a thin wire and is free from soldering, welding or mechanical joints at the contact point between fuse and terminal.

The dimensions of an internal fuse in a power capacitor are determined by two opposing criteria, namely that —the current load from the current which is estimated to flow through the fuse when the sub-capacitor to which it is series-connected is short-circuited shall be so large that the wire melts, and that —at the same time the fuse is to withstand the current load which arises when the entire capacitor and hence all the capacitor elements are discharged. To limit the energy load on the fuse, it is an advantage if the fuse terminals can be dimensioned such that part of the discharge energy is absorbed in the fuse terminals. A fuse designed according to the present invention can be optimized in a simple and rational way to meet the above-mentioned demands for resistance and energy absorption capacity in the conductors in relation to those in the fuse element. The energy absorption capacity and resistance of a terminal depend, in addition to the dimension and material of the wire, on the length of the conductor, the number of twisted wires, strands, in the terminal, as well as the pitch during the twisting operation. On the basis of the requirements described above, it has proved to be particularly suitable with terminals in the form of three or five strands, corresponding to one or two rings or loops, in fuses which are to be used for internal fuses in power capacitors. To optimize the resistance and energy absorption capacity of the terminals in relation to the resistance and energy absorption capacity of the fuse element, with fuses manufactured according to the current technique, it is required that the terminals, which are designed as separate parts in the form of wires, plates, etc., are manufactured in a number of different dimensions to be able to be combined with fuse elements of different dimensions and rated currents.

The use of a fuse, manufactured according to the method of the invention, as an internal fuse in a power capacitor results in the following advantages:

—the negative influence in the form of inhomogeneities in the material properties, which arise by the action of heat during welding/soldering or by mechanical damage upon contacting with clamping joints, at the transition between terminal and fuse element, is avoided;

—pointwise mechanical load, from electrically loaded material, from pressure points, i.e. solder lumps, welding material, mechanical clamps or the like, at the transition between terminal and fuse element, is avoided;

—the resistance and energy absorption capacity of the terminal can be optimized, in a simple and rational way, in relation to the corresponding properties of the fuse element;

—an improvement of the protective function is obtained by the use of a thinner wire in the fuse element; and —capacitor designs with thinner fuses can be selected.

In addition to the above enumerated advantages, a rational basis for the manufacture of fuses is also obtained, as generally is the case for other types of fuses.

BRIEF DESCRIPTION OF THE DRAWINGS

The invention will be described in greater detail in the following with reference to the accompanying drawings.

DESCRIPTION OF THE PREFERRED EMBODIMENTS

Figure 1:
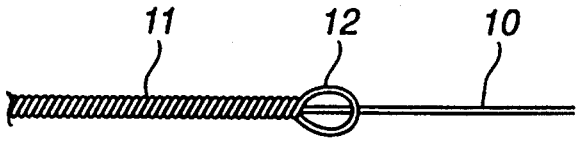
FIGS. 1 and 2 show fuses manufactured by means of the invented method.

FIG. 1 shows a fuse comprising a fuse element 10 in the form of a thin wire and at least one terminal 11. The problems arising in connection with the contacting 12 or the transition between the terminal 11 and the fuse element 10 are avoided in that the wire, which constitutes the fuse element 10, is also adapted to form part of the terminal 11 twisted together with an additional number of wires formed in a ring or loop (as described below). The conductor 11 has been produced by moving the wire, which also constitutes the fuse element 10, in those parts which constitute the terminal, back and forth a number of times to form at least one ring or loop, and by twisting this ring or loop together with part of the wire which also constitutes the fuse element 10 into a terminal 11.

Figure 2:
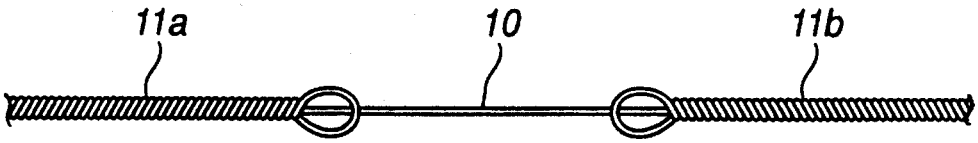

FIG. 2 shows a fuse comprising two terminals 11*a*, 11*b* with an intermediate fuse element 10 in the form of a wire. The terminals 11*a*, 11*b* have a larger cross section area that the fuse element 10. The thin wire which constitutes the fuse element 10 is also adapted to form part of the terminals, twisted together with an additional number of wires formed in a ring or loop (as described below). The terminals 11*a*, 11*b* have been produced by moving the wire, which constitutes the intermediate fuse element 10, in those parts which constitute the terminal back and forth a number of times to form at least one ring or loop, and by twisting this ring or loop together with at least part of the wire which also constitutes the fuse element 10 into a terminal.

Since soldering, welding, or mechanical joints have not been used for the contacting 12 or the transition in fuses according to FIGS. 1 and 2, the problems arising in connection with the critical transition between terminals 11, 11*a*, 11*b* and fuse element 10 are avoided.

The fuse element 10 and the terminals 11, 11*a*, 11*b* are preferably made from a thin metal wire with a diameter smaller than 0.5 mm. Particularly advantageous are fuses in which the fuse element 10 and the terminals 11, 11*a*, 11*b* are made in one piece from a thin wire of copper, aluminium, silver, an alloy based on any of these metals, as well as electroplated nickel silver or any other metal or alloy with a resistivity and melting point suitable for the application.

From the point of view of protective function, it is advantageous with fuses made of thin metal wire. With a conventionally designed fuse where the contacting 12 between the fuse element 10 and the terminals 11, 11*a*, 11*b* is performed by means of welding, soldering, or a mechanical pressure contact, metal wires with a diameter smaller than 0.3 mm cannot normally be used, whereas a fuse designed according to the present invention is advantageously designed from metal wires of a diameter smaller than 0.3 mm.

Figure 3A:
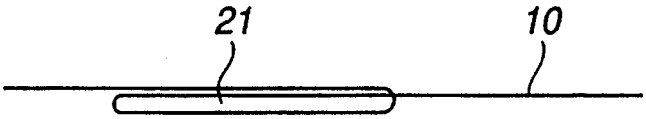
FIGS. 3*a* and 3*b* show the invented method for the manufacture of fuses.

FIG. 3*a* shows the invented method for the manufacture of a fuse according to FIG. 1, the fuse element 10 and the conductor 11 being made from the same wire by moving the wire back and forth to form at least one ring 21 or loop. The ring or rings 21 obtained are twisted into a terminal 11, whereby also part of the wire, which is adapted to constitute the fuse element 10, is twisted together with the wires included in the ring. The manufacture of fuses according to the invented method simplifies the manufacture of fuses in relation to the known technique since no joining together of different components is required and all material, wire, is taken from the same roll.

Figure 3B:
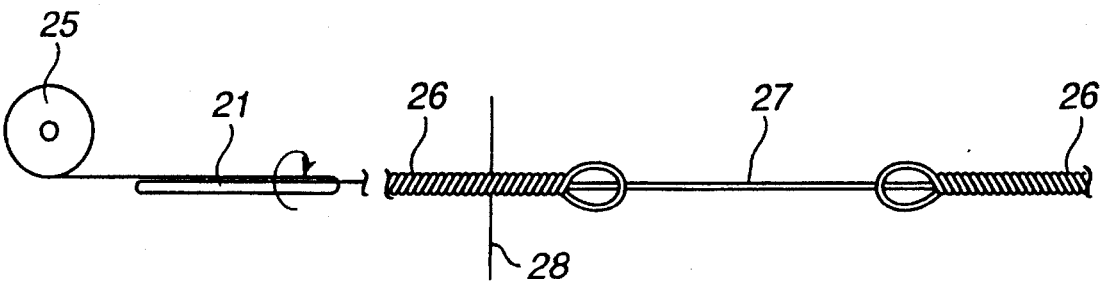

A preferred embodiment of the method according to the invention, in which fuses comprising two terminals and an intermediate fuse element, in the form of a single wire, are manufactured from the same wire is shown in FIG. 3*b*. The wire, which is preferably fed from a material roll 25, is moved section-by-section back and forth a number of times to form at least one ring 21, or loop. The rings 21 formed are twisted together into sections 26 which have a larger cross section area than the wire. Alternately with these sections of twisted-together wires, sections 27 in the form of a single wire are arranged. After the wire has been formed into a body, comprising sections 27, in the form of single wire, arranged alternately in the longitudinal direction with sections 26, in the form of a number of twisted wires, the body is cut in the twisted sections 26 as shown at 28. Cut parts are arranged to form fuses according to FIG. 2, comprising two terminals 11*a*, 11*b* and an intermediate fuse element 10.

Figure 4A:
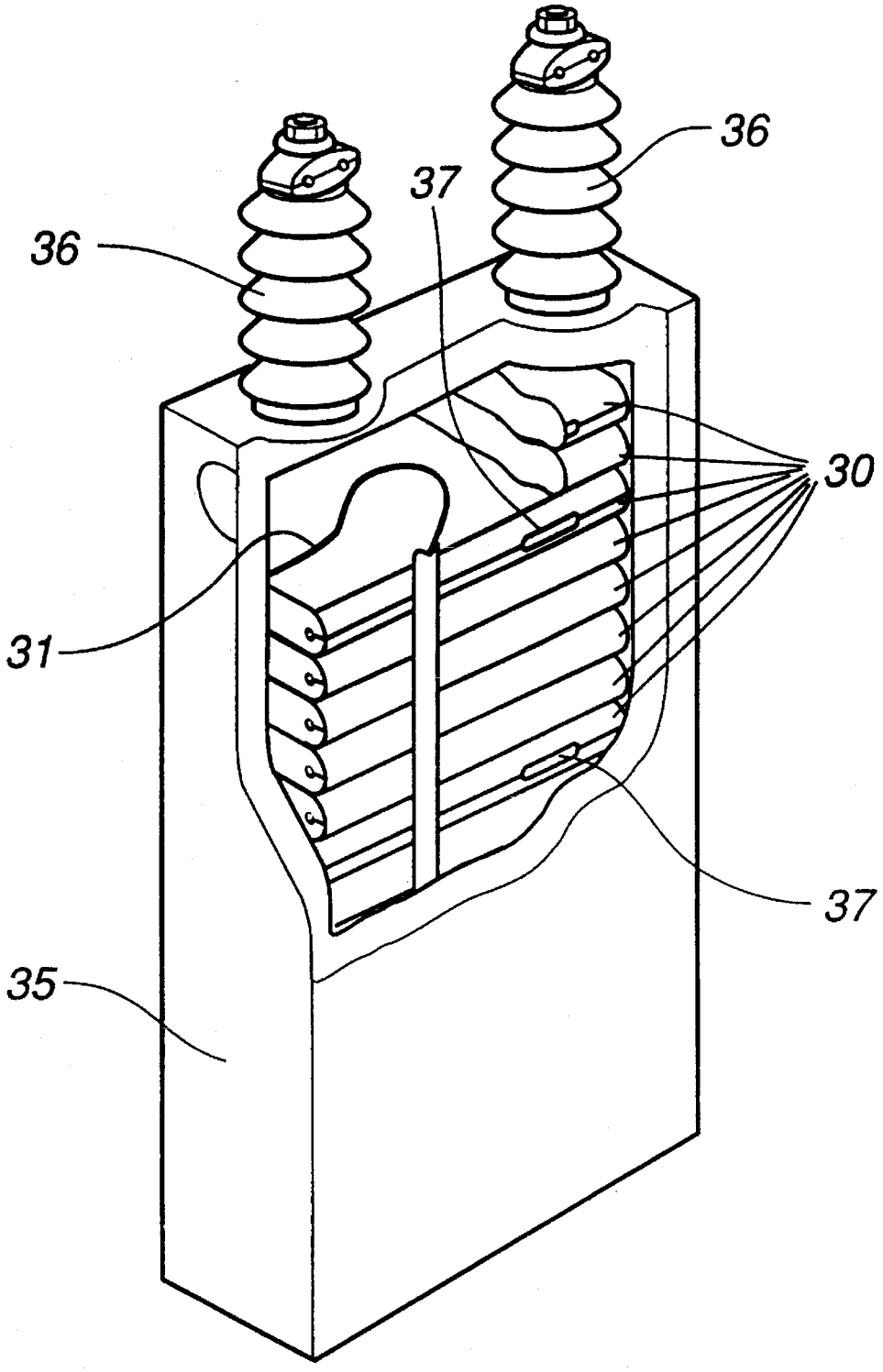
FIGS. 4*a* and 4*b* show the use of fuses, manufactured according to the invented method, in power capacitors.
Figure 4B:
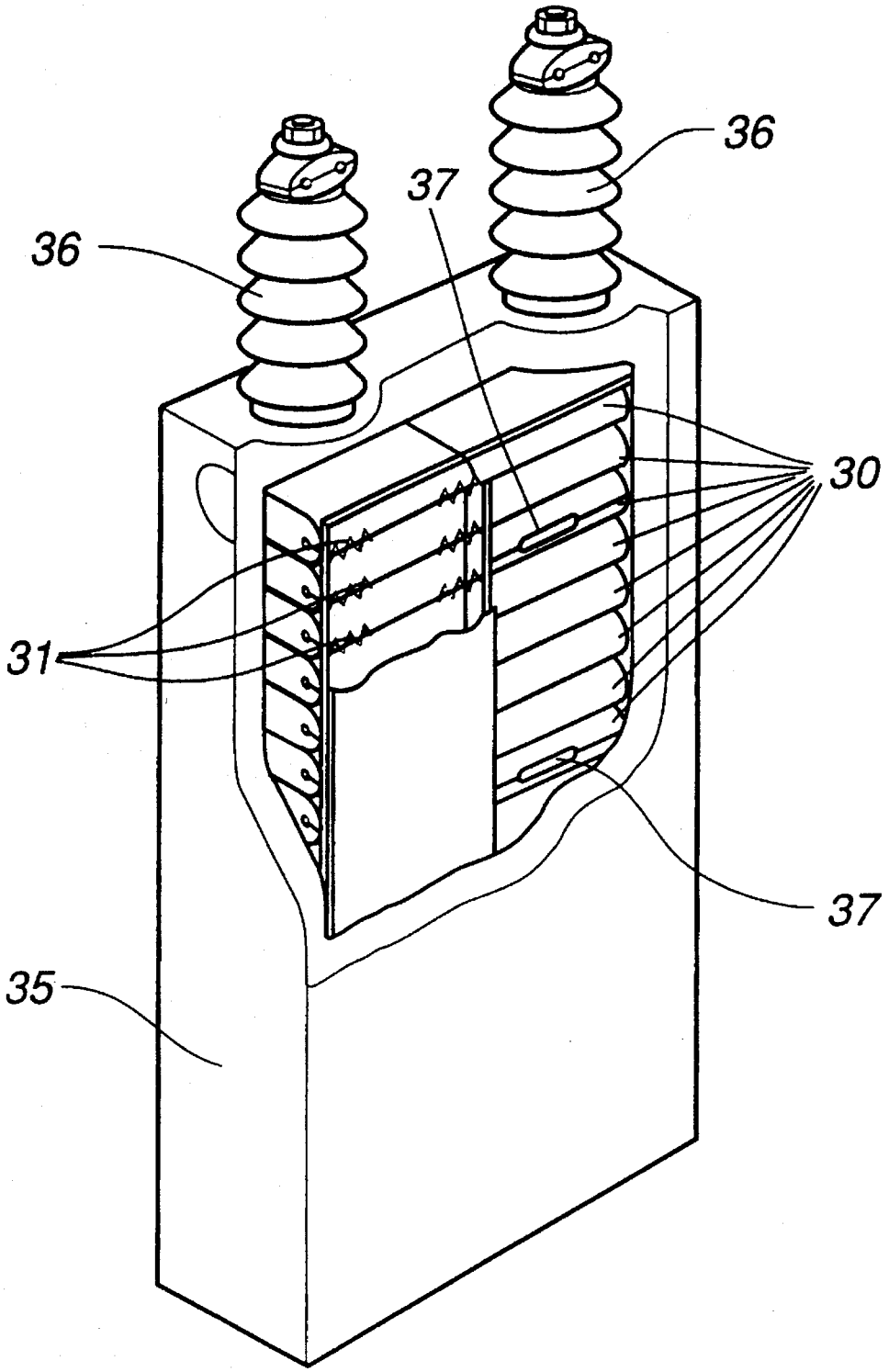

FIGS. 4*a* and 4*b* show the use of a fuse, manufactured according to the method described above, in a power capacitor.

The use of a fuse, manufactured by a method according to the invention, in a power capacitor comprising a number of capacitor elements 30 in which each capacitor element is connected in series with an internal fuse 31, which comprises a fuse element and terminals, and in which a thin wire which constitutes the fuse element is also adapted to be included, in part, in the terminals twisted together with an additional number of wires, is particularly valuable.

Power capacitors comprising a number of sub-capacitors 30 or capacitor elements are shown in FIGS. 4*a* and 4*b*. The capacitor elements 30 are so-called wound foil capacitors, composed of a plurality of wound turns of metal foils, serving as electrodes, and a solid dielectric arranged between the turns, preferably in the form of polymer film or paper. The wound foil capacitors are arranged stacked on top of each other and are electrically connected together. The stacks of capacitor elements 30 are arranged enclosed in a container 35 which is provided with electric bushings 36 for connection of the power capacitor. For discharge of the power capacitor, discharge resistors 37 are arranged.

The capacitor elements 30 are protected by means of fuses 31. In power capacitors with internal fuses 31, each capacitor element 30 is connected in series with its own internal fuse 31, which means that the fuses 31 have to be mounted inside or in close proximity to the capacitor element 30 in such a way as to occupy a minimum space. The fuses 3 are preferably mounted between two capacitor elements 30. Alternatively, as shown in FIG. 4*b*, a number of fuses are mounted close to each other between plates of an electrically insulating material, for example pressboard plates.

The fuses 31 are thus mounted clamped between electrically loaded material, whereby any form of mechanical pressure point, such as solder lumps, welding material, or mechanical joints, is negative. With a method according to the invention, a fuse 31 may advantageously be made starting from a thin wire and without soldering, welding, or a mechanical joint at the contact point between the fuse and the terminals.

The dimension of an internal fuse 31 in a power capacitor is determined by two opposite dimensioning criteria, namely that —the current load from the current which is estimated to flow through the fuse 31 when the sub-capacitor 30 to which it is series-connected is short-circuited shall be so large that the wire melts, and that —at the same time the fuse 31 is to withstand the current load which arises when the entire capacitor and hence all the capacitor elements 30 are discharged. To limit the energy load on the fuse 31, it is an advantage if terminals can be dimensioned such that part of the discharge energy is developed in the terminals. A fuse 31 designed according to the present invention can be optimized in a simple and rational way to meet the above-mentioned demands for resistance and energy absorption capacity in the conductors in relation to those in the fuse element. The energy absorption capacity and resistance of a terminal depend, in addition to the dimension and material of the wire, on the length of the terminal, the number of twisted wires, strands, in the terminal, as well as the pitch during the twisting operation. On the basis of the requirements described above, it has proved to be particularly suitable with terminals in the form of three or five strands, corresponding to one or two rings or loops, in fuses which are to be used for inner fuses 31 in power capacitors. To optimize the resistance and energy absorption capacity of the terminals in relation to the resistance and energy absorption capacity of the fuse element, with fuses manufactured according to the current technique, it is required that the terminals, which are designed as separate parts in the form of wires, plates, etc., are manufactured in a number of different dimensions to be able to be combined with fuse elements of different dimensions and rated currents.

The use of a fuse, manufactured according to the method of the invention, as an internal fuse 31 in a power capacitor results in the following advantages:

—the negative influence in the form of inhomogeneities in the material properties, which arise by the action of heat during welding/soldering or by mechanical damage upon contacting with clamping joints, at the transition between terminal and fuse element, is avoided;

—pointwise mechanical load, from electrically loaded material, from pressure points, i.e. solder lumps, welding material, mechanical clamps or the like, at the transition between terminal and fuse element, is avoided;

—the resistance and energy absorption capacity of the terminal can be optimized, in a simple and rational way, in relation to the corresponding properties of the fuse element;

—an improvement of the protective function is obtained by the use of a thinner wire in the fuse element; and —capacitor designs with thinner fuses can be selected.

The use of fuses manufactured by a method according to the invention in power capacitors has been described above only referring to power capacitors built up from capacitor elements in the form of so-called wound foil capacitors. Fuses according to the invention are, of course, suitable also in other types of power capacitors.

We claim:

1. A method for manufacturing a continuous string of fuses from a single strand of fuse wire, each fuse having at least one fuse element and at least one terminal, comprising the steps of:

forming said at least one fuse element from said single strand of wire;

moving said single strand of wire back and forth over a portion of said single strand of wire forming said fuse element to form at least one ring or loop;

twisting said at least one ring or loop to form said terminal with said ring or loop at the junction of said fuse element and said terminal; and successively repeating said step of moving and twisting to form the continuous string of fuses.

2. A method according to claim 1, wherein said single strand of wire has a diameter smaller than 0.5 mm.

3. A method according to claim 1, wherein said single strand of wire is made from one of the following group of elements consisting of copper, copper alloy, silver, silver alloy, aluminum, aluminum alloy and electroplated nickel silver and having a diameter less than 0.3 mm.

4. A method according to claim 1, further comprising the step of cutting the continuous string of fuses substantially at the midpoint of each terminal to form individual fuses.

5. A method according to claim 1, wherein each fuse includes first and second terminals interconnected by said fuse element and said first terminal is formed by said steps of moving and twisting, and further comprising the additional step of moving said single strand of wire back and forth over another portion of said single strand of wire forming said fuse element to form at least one other ring or loop; and twisting said fuse element, said first terminal and said other ring or loop to form said second terminal with said other ring or loop at the junction of said fuse element and said second terminal; and successively repeating said step of moving and twisting, said additional step of moving and said steps of twisting to form the continuous string of fuses.

6. A method according to claim 5, wherein said single strand of wire has a diameter smaller than 0.5 mm.

7. A method according to claim 5, wherein said single strand of wire is made from one of the following group of elements consisting of copper, copper alloy, silver, silver alloy, aluminum, aluminum alloy and electroplated nickel silver and having a diameter less than 0.3 mm.

8. A method according to claim 5, further comprising the step of cutting the continuous string of fuses at substantially the midpoint of said second terminal to form individual fuses comprising said first and second terminals and said fuse element.

9. A continuous string of fuses having at least one fuse element formed of a single strand of said single strand of wire, comprising:

at least one fuse element formed from said single strand of fuse wire;

at least one terminal partially formed by moving said single strand of wire back and forth over a portion of said single strand of wire forming said fuse element to form at least one ring or loop;

said terminal being completely formed with said ring or loop at the junction of said fuse element and said terminal by twisting said at least one ring or loop; and the continuous string of fuses being formed by successively repeating said step of moving and twisting.

10. A continuous string of fuses according to claim 9, wherein said single strand of wire has a diameter smaller than 0.5 mm.

11. A continuous string of fuses according to claim 9, wherein said single strand of wire is made from one of the following group of elements consisting of copper, copper alloy, silver, silver alloy, aluminum, aluminum alloy and electroplated nickel silver and having a diameter less than 0.3 mm.

12. A continuous string of fuses according to claim 9, wherein the at least one fuse is obtained by cutting the continuous string of fuses substantially at the mid-point of each terminal.

13. A continuous string of fuses according to claim 9, wherein each fuse includes first and second terminals interconnected by said fuse element and said first terminal is formed by said steps of moving and twisting and said second terminal is formed by moving said single strand of wire back and forth over another portion of said single strand of wire forming said at least one fuse element to form at least one other ring or loop; said other ring or loop is formed at the junction of said fuse element and said second terminal by twisting said fuse element, said first terminal and said other ring or loop; said continuous string of fuses being formed by successively repeating said step of moving and twisting, said additional step of moving and said steps of twisting.

14. A continuous string of fuses according to claim 13, obtaining individual fuses comprising said first and second terminals and said fuse element by cutting the continuous string of fuses at substantially the mid-point of said second terminal.

* * * * *